US006467571B2

(12) United States Patent
Nakagawa

(10) Patent No.: US 6,467,571 B2
(45) Date of Patent: Oct. 22, 2002

(54) SOUND ABSORBING MATERIAL, MUFFLER USING THE SOUND ABSORBING MATERIAL, AND METHOD FOR FORMING SOUND ABSORBING LAYER THEREOF

(75) Inventor: Yukihiro Nakagawa, Kasugai (JP)

(73) Assignees: Nakagawa Sangyo Co., Ltd., Nishikasugai-gun (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/732,912

(22) Filed: Dec. 11, 2000

(65) Prior Publication Data

US 2002/0070076 A1 Jun. 13, 2002

(51) Int. Cl.[7] ..... F01N 1/10; B21D 53/02; D04H 1/16

(52) U.S. Cl. ..... 181/252; 181/256; 29/890.03; 264/113

(58) Field of Search ..... 181/248, 249, 181/252, 255, 256, 258, 269, 272, 282; 29/890.03; 264/113, 122; 141/11, 12, 7

(56) References Cited

U.S. PATENT DOCUMENTS 4,269,800 A * 5/1981 Sommer et al. ..... 264/113
4,569,471 A 2/1986 Ingemansson et al.
4,774,985 A 10/1988 Broadbelt et al.
5,912,441 A 6/1999 Worner
5,926,954 A 7/1999 Wolf et al.
6,053,276 A * 4/2000 D'Amoco, Jr. et al. ..... 181/243
6,094,817 A 8/2000 Shah et al.
6,148,955 A * 11/2000 Wolf et al. ..... 181/252
6,158,547 A * 12/2000 Ackermann et al. ..... 181/256
6,196,351 B1 * 3/2001 Clokey et al. ..... 181/252

FOREIGN PATENT DOCUMENTS

| | | |
|---|---|---|
| EP | 0074 220 | 3/1983 |
| EP | 0153 100 | 8/1985 |
| EP | 0714 087 | 5/1996 |
| WO | 9824615 | 6/1998 |

* cited by examiner

*Primary Examiner*—Khanh Dang
(74) *Attorney, Agent, or Firm*—Stevens, Davis, Miller & Mosher, LLP

(57) ABSTRACT

In order to provide a sound absorbing material superior in acid resistance, alkali resistance and sound absorbing quality and a sound absorbing layer using this sound absorbing material, multiple pieces of basalt yarn obtained by dissolving basalt to be continuous fibers are bundled by a fiber bundling agent to acquire a bundled material, and the bundled material is fibrillated to obtain a bulky sound absorbing material. Moreover, the sound absorbing material is arranged on the outer periphery of a perforated pipe constituting a muffler to form a sound absorbing layer.

16 Claims, 3 Drawing Sheets

SOUND ABSORBING MATERIAL, MUFFLER USING THE SOUND ABSORBING MATERIAL, AND METHOD FOR FORMING SOUND ABSORBING LAYER THEREOF

FIELD OF THE INVENTION

The present invention relates to a sound absorbing material used for a muffler of an internal combustion engine, a muffler using this sound absorbing material, and a method for forming a sound absorbing layer of the muffler.

RELATED ART

A muffler aiming at sound reduction of exhaust gas is arranged in an exhaust system of an internal combustion engine of an automobile.

A muffler uses a sound absorbing material for preventing high frequency sound, and that sound absorbing material is mainly made of glass fiber.

As to arrangement of the muffler, a sub muffler and a pre muffler are arranged on the downstream side of an exhaust emission purifier using a catalyst, and a main muffler is arranged on the downmost stream side. Such a sub muffler and a pre muffler may be positioned at a short distance from the exhaust emission purifier, and, in such a case, a high temperature of the exhaust gas or large pulsation may influence on the sub muffler or the pre muffler.

In the related art, therefore, it is general that stainless wool is wound around a porous exhaust tube of the sub muffler or the pre muffler and a sound absorbing material such as glass fiber is wound around the outer periphery thereof or internally filled.

Although the glass fiber used as a sound absorbing material accomplishes the quality which can withstand use in various temperature ranges, the resistance property with respect to acid things or alkaline things included in the exhaust gas is insufficient. The glass fiber may be, therefore, degraded/broken and emitted into the air together with the exhaust gas.

SUMMARY OF THE INVENTION

In view of the above-described problems, an object of the present invention is to provide a sound absorbing material which is superior in acid resistance, alkali resistance and sound absorbing qualities, a muffler using this sound absorbing material, and a method for forming a sound absorbing layer of the muffler.

To achieve this aim, a first aspect according to the present invention provides a sound absorbing material, wherein multiple pieces of basalt yarn obtained by dissolving basalt to be tuned into continuous fibers are bundled to be a bundled material by using a fiber bundling agent and the bundled material is fibrillated to be bulky.

A second aspect according to the present invention provides a muffler, wherein multiple pieces of basalt yarn obtained by dissolving basalt to be continuous fibers are bundled as a bundled material by using a fiber bundling agent, and a sound absorbing material obtained by fibrillating the bundled material to be bulky is provided on the outer peripheral portion of a perforated pipe.

A third aspect according to the present invention relates to a method for forming a sound absorbing layer using the above-described sound absorbing material, comprising the steps of: bundling multiple pieces of basalt yarn obtained by dissolving basalt to be continuous fibers as a bundled material by using a fiber bundling agent; forming a bulky sound absorbing material by fibrillating this bundled material; and forming a sound absorbing layer by arranging the sound absorbing material on the outer peripheral portion of a perforated pipe which constitutes the muffler.

Further, with respect to the third aspect, in the step for forming the fibrillated sound absorbing material, the bundled material may be supplied in a nozzle, compressed air may be blown into the nozzle and the bundled material may be unraveled by this compressed air to continuously form the fibrillated sound absorbing material by using the nozzle.

Furthermore, with respect to the present invention, in the step for arranging the fibrillated sound absorbing material on the outer peripheral portion of the perforated pipe, the sound absorbing material may be supplied on the outer periphery of the perforated pipe while rotating the perforated pipe around its axis so that the sound absorbing material is wound around the perforated pipe.

Moreover, with respect to the present invention, when supplying the fibrillated sound absorbing material on the outer peripheral portion of the perforated pipe, the sound absorbing material may be supplied to the perforated pipe while giving tension to the sound absorbing material by a tension roller.

A fourth aspect according to the present invention provides a method for forming a sound absorbing layer, comprising the steps of: bundling multiple pieces of basalt yarn obtained by dissolving basalt to be continuous fibers as a bundled material by a fiber bundling agent; forming a bulky sound absorbing material by fibrillating the bundled material; and forming a sound absorbing layer by inserting and filling the sound absorbing material into a space between an outer pipe and a perforated pipe constituting a muffler.

DETAILED DESCRIPTION OF THE PREFERRED EMBODIMENT

Figure 1A:
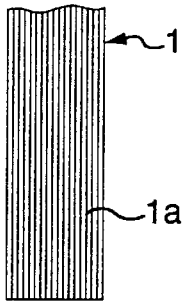
FIGS. 1A to 1G are views showing an embodiment of a sound absorbing material and a method for forming the sound absorbing material according to the present invention, each of which illustrates each process.
Figure 1B:
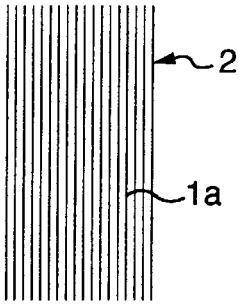

With respect to a sound absorbing material according to the present invention, basalt which is a natural mineral substance is dissolved to be continuous fibrous basalt yarn, and a fiber bundling agent is added to a bundle of multiple pieces of the basalt yarn 1*a* to obtain a long bundled material 1 as shown in FIG. 1A, and the bundled material 1 is bulked to obtain a fiber bundle type sound absorbing material 2 as shown in FIG. 1B.

Although a fiber diameter of one piece of the continuous fiber basalt yarn 1*a* can be set to any desired value, the diameter of 9 $\mu$ to 24 $\mu$ is ideal. Further, although a number of pieces of the basalt yarn 1*a* used in the bundled material 1 can be set to any desired value, 1000 to 4000 pieces are used for example.

Figure 2:
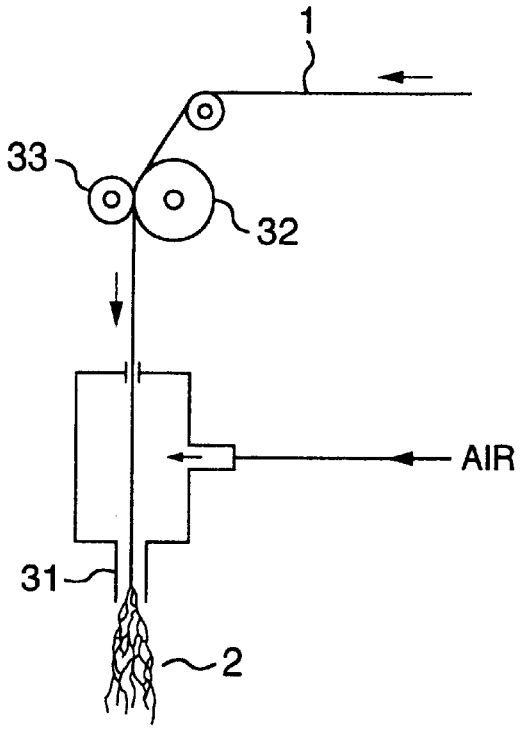
FIG. 2 is a view showing a method for making a bundled material into a bulky fiber bundle in the embodiment in FIGS. 1A to 1G.

In addition, as a method for making the bundled material 1 into the bulky fiber bundle, for example, the bundled material 1 is supplied into a nozzle 31 by a feed roller 32 and a pinch roller 33 and compressed air is blown into the nozzle 31, as shown in FIG. 2. The bundled material 1 is unraveled into filaments to be continuously fed by the nozzle 31, thereby continuously manufacturing the sound absorbing material 2 fibrillated into a bulky state.

The sound absorbing material 2 is wound around a perforated pipe of the muffler.

Figure 1C:
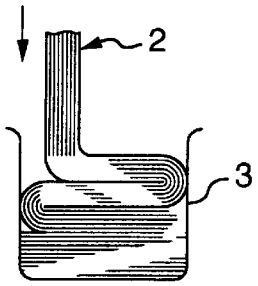

In the first place, as described above, the sound absorbing material 2 continuously formed into a long shape is stocked in a stocker 3 as shown in FIG. 1C. Here, a bundle of the sound absorbing material 2 is in the fibrillated state and stocked in a sizable amount.

Figure 1D:
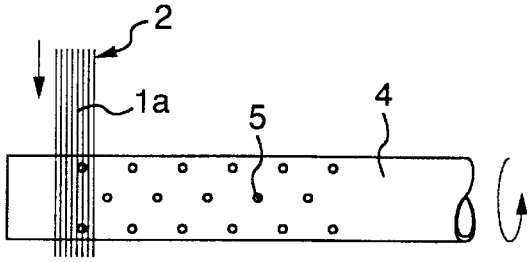

Next, the sound absorbing material 2 stocked in the stocker 3 is drawn from the stocker 3 and wound around the outer peripheral surface of a perforated pipe constituting a muffler, e.g., an inner pipe 4 as shown in FIG. 1D. Small holes 5 are formed in the inner pipe 4, and the sound absorbing material 2 is wound in an area where the small holes 5 are formed. Further, as a winding method, the sound absorbing material 2 is reciprocated in the axial direction of the inner pipe 4 by a traverse mechanism and the like while rotating the inner pipe 4 around an axis thereof by appropriate rotating means so that the sound absorbing material is wound. A winding amount of the sound absorbing material is set to a desired value, and the sound absorbing material 2 is wound once or multiple times in accordance with a reciprocation amount of a bundle of the sound absorbing material 2.

It is to be noted that a bundle of the sound absorbing material 2 may be wound as described above but two, three or multiple bundles of the sound absorbing material 2 may be simultaneously wound according to productivity.

Figure 1E:
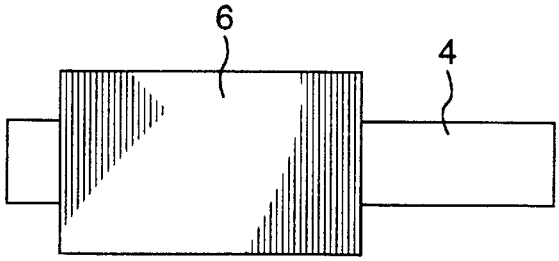

FIG. 1E shows the state where the sound absorbing material 2 is wound as described above, and this winding forms a sound absorbing layer 6 of the bulky basalt yarn.

Figure 3:
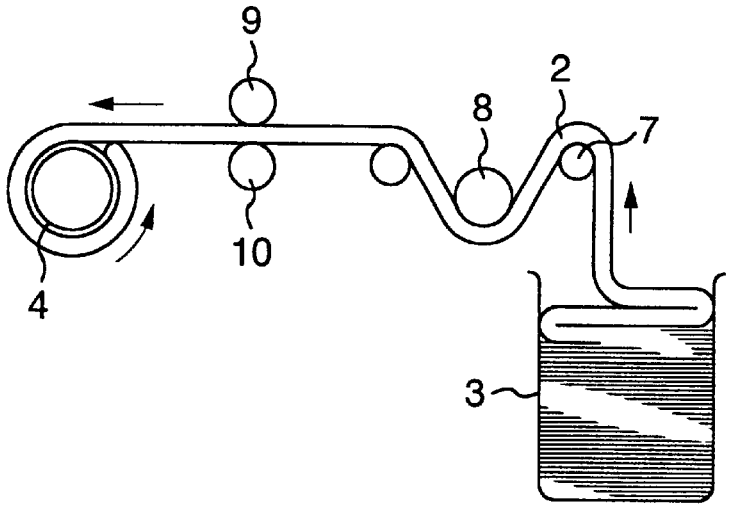
FIG. 3 is a view showing an example of the process for supplying a sound absorbing material in a sound absorbing material forming process into a perforated pipe according to the present invention.

Additionally, as a method for supplying the sound absorbing material 2 in the stocker 3 into the inner pipe 4 as mentioned above, the sound absorbing material 2 is pulled out from the stocker 3 by supply rollers 7 and 8 and the drawn sound absorbing material 2 is inserted between tension rollers 9 and 10 so that the end of the sound absorbing material 2 is supplied to and wound around the inner pipe 4, for example, as shown in FIG. 3. In this manner, by providing the tension rollers 9 and 10, the tension adjustment of the tension rollers 9 and 19 can control the density and the weight of the sound absorbing material 2 to be wound around the inner pipe 4.

It is to be noted that the tension rollers 9 and 10 may not be used according to the density required for the sound absorbing layer 6. That is, only the friction of the sound absorbing material 2 and a member for supplying the sound absorbing material 2 may be used.

Figure 1F:
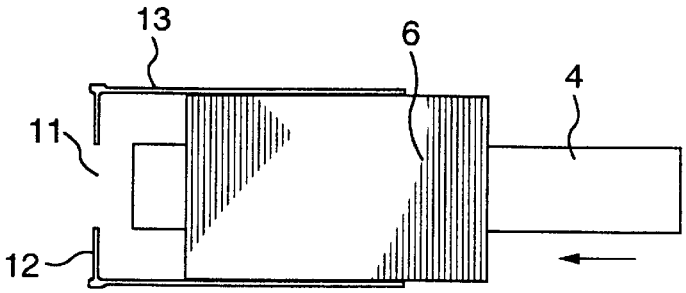

After forming the sound absorbing layer 6 on the inner pipe 4 as shown in FIG. 1E, the inner pipe 4 on which the sound absorbing layer 6 is formed is inserted into an outer pipe 13 having at one end an end plate 12 in which an inner pipe insertion hole 11 is formed, from an opening at the other end thereof as shown in FIG. 1F. At this time, the sound absorbing layer 6 has the external diameter which can be fully fitted to the inner surface of the outer pipe 13.

Figure 1G:
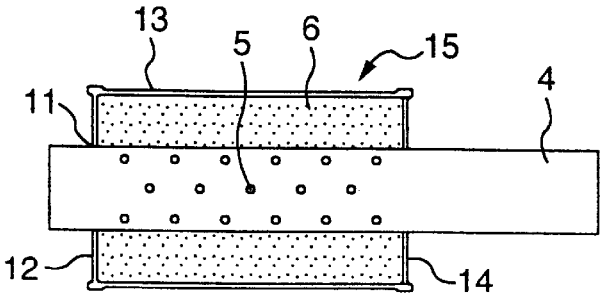

After the inner pipe 4 and the sound absorbing layer 6 are inserted into the outer pipe 13 as shown in FIG. 1G, the other end plate 14 is fixed to the outer pipe 13 as illustrated in FIG. 1G, thereby finishing the muffler 15.

Although the above embodiment is an example where the present invention is applied to the inner pipe, the present invention can be similarly applied in a case of providing the above mentioned sound absorbing layer 6 on any other perforated pipe, e.g., a perforated portion of an outlet pipe and the like.

Figure 4:
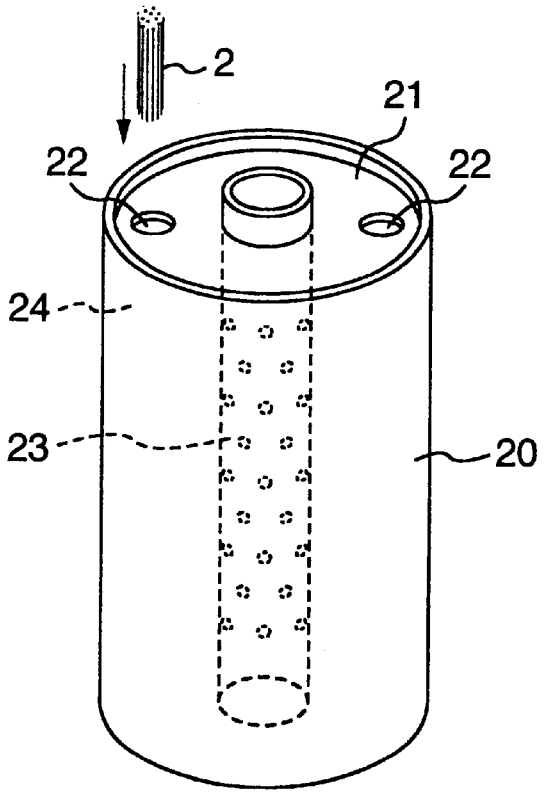
FIG. 4 is a view showing an example of another forming method in a sound absorbing layer forming method according to the present invention.

As to filling the sound absorbing material 2 into the muffler, as shown in FIG. 4, insertion holes 22 may be formed to the end plate 21 of the outer pipe 20 constituting the muffler and the sound absorbing material 2 may be inserted into and filling in a space 24 between the outer pipe 20 and the perforated pipe 23 from the insertion holes 22, thereby forming the sound absorbing layer by the sound absorbing material 2.

Figure 5:
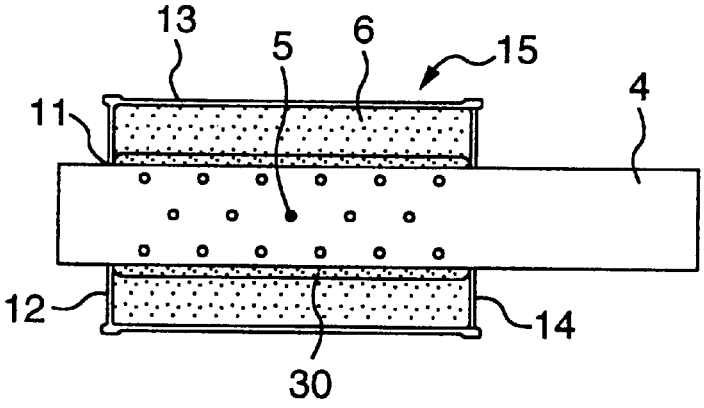
FIG. 5 is a cross-sectional view showing another example of the sound absorbing layer according to the present invention.

Moreover, as shown in FIG. 5, after the stainless wool 30 may be wound around the outer periphery of the perforated pipe 4, the sound absorbing material 2 may be wound around the outer periphery of the stainless wool 30 to form the sound absorbing layer 6. Similarly as the above, the sound absorbing material 2 is obtained by bundling multiple pieces of the basalt yarn 1*a* and making the bundled material bulky to be a fiber bundle, and the method for winding this sound absorbing material 2 is similar to the above.

As described above, since the sound absorbing material according to the first aspect of the present invention is constituted by the basalt yarn obtained by dissolving the basalt to be the continuous fiber, it can not be absorbed into the perforated pipe by an exhaust flow to be emitted into the air like the discontinuous short fiber. Further, the sound absorbing material is superior in acid resistance and alkali resistance and can not be degraded and broken by an acid substance or an alkali substance in the exhaust air to be emitted into the air like the glass wool in the related art. In addition, since the basalt yarn is bundled and the bundled material is fibrillated to be bulky, the sound absorbing property can be improved.

According to the second aspect of the present invention, by providing the sound absorbing material on the outer peripheral portion of the perforated pipe, the muffler having the above-described effect can be obtained.

According to the method for forming the sound absorbing layer in the third aspect of the present invention, the sound absorbing layer having the effect using the basalt yarn mentioned above can be formed. Further, since the sound absorbing material consisting of the fiber bundle obtained by making multiple pieces of the basalt yarn bulky is provided on the outer periphery of the perforated pipe to form the sound absorbing layer, the density of the entire sound absorbing layer can be more equalized than that obtained by filling the discontinuous short fiber in the muffler in the related art, thereby improving the sound absorbing performance.

In the step for forming the fibrillated sound absorbing material according to the third aspect, the bundled material is supplied into the nozzle while blowing the compressed air into the nozzle, and the bundled material is unraveled by the compressed air to form the continuously fibrillated sound absorbing material from the nozzle, thereby readily and continuously performing the above fibrillation.

Moreover, according to the present invention, in the third aspect or the above description, the step for arranging the fibrillated sound absorbing material on the outer peripheral portion of the perforated pipe can facilitate winding the sound absorbing material around the perforated pipe by supplying the sound absorbing material to the outer periphery of the perforated pipe while rotating the perforated pipe around the axis thereof and winding the sound absorbing material around the perforated pipe.

When supplying the fibrillated sound absorbing material to the outer peripheral portion of the perforated pipe, the sound absorbing material can be supplied to the perforated pipe while applying tension to the sound absorbing material by the tension roller so that the tension can be adjusted during supply of the sound absorbing material, which can readily adjust the density of the sound absorbing layer to be formed.

As the fourth aspect according to the present invention, even if the sound absorbing material is inserted and filled into the muffler, the same effect as the third aspect can be obtained.

What is claimed is:

1. A muffler, comprising a perforated pipe and a continuous, bulky, fibrillated sound absorbing material which is continuously produced, said fibrillated sound absorbing material being wound on an outer peripheral portion of said perforated pipe and comprising multiple pieces of basalt yarn, which are obtained by dissolving basalt to be continuous fibers that are bundled by a fiber bundling agent to acquire a bundled material and that are fibrillated to be bulky.

2. The muffler according to claim 1, wherein a layer made of stainless wool is first provided on said outer peripheral portion of the perforated pipe, and then, said fibrillated sound absorbing material is wound on an outer peripheral portion of the stainless wool layer.

3. The muffler according to claim 1, wherein the fibrillated sound absorbing material is wound on the outer peripheral portion of the perforated pipe while giving tension to said sound absorbing material.

4. The muffler according to claim 2, wherein the fibrillated sound absorbing material is wound on the outer peripheral portion of the perforated pipe while giving tension to said sound absorbing material.

5. A method for forming a muffler, comprising the steps of:

bundling multiple pieces of basalt yarn obtained by dissolving basalt to be continuous fibers by a fiber bundling agent to acquire a bundled material;

fibrillating said bundled material to be bulky and to form a continuous, bulky, fibrillated sound absorbing material which is continuously produced; and continuously winding said fibrillated sound absorbing material on an outer peripheral portion of a perforated pipe of a muffler to form a sound absorbing layer on said perforated pipe.

6. The method for forming a muffler according to claim 5, wherein, in said step of forming said fibrillated sound absorbing material, said bundled material is supplied into a nozzle while blowing compressed air into said nozzle and said bundled material is unraveled by said compressed air to form said continuously fibrillated sound absorbing material from said nozzle.

7. The method for forming a muffler according to claim 5, wherein, in said step of winding said fibrillated sound absorbing material on said outer peripheral portion of said perforated pipe, said sound absorbing material is supplied to said outer peripheral portion of said perforated pipe while rotating said perforated pipe around an axis thereof and said sound absorbing material is wound around said outer peripheral portion of said perforated pipe.

8. The method for forming a muffler according to claim 6, wherein, in said step of winding said fibrillated sound absorbing material on said outer peripheral portion of said perforated pipe, said sound absorbing material is supplied to said outer peripheral portion of said perforated pipe while rotating said perforated pipe around an axis thereof and said sound absorbing material is wound around said outer peripheral portion of said perforated pipe.

9. The method for forming a muffler according to claim 7, wherein, when winding said fibrillated sound absorbing material on said outer peripheral portion of said perforated pipe, said sound absorbing material is supplied to said perforated pipe while a tension roller gives tension to said sound absorbing material.

10. The method for forming a muffler according to claim 8, wherein, when winding said fibrillated sound absorbing material on said outer peripheral portion of said perforated pipe, said sound absorbing material is supplied to said perforated pipe while a tension roller gives tension to said sound absorbing material.

11. The method for forming a muffler according to claim 5, wherein, before the step of winding the fibrillated sound absorbing material on the outer peripheral portion of the perforated pipe, there is performed a step of providing a layer made of stainless steal wool on the outer peripheral portion of the perforated pipe.

12. The method for forming a muffler according to claim 6, wherein, before the step of winding the fibrillated sound absorbing material on the outer peripheral portion of the perforated pipe, there is performed a step of providing a layer made of stainless steal wool on the outer peripheral portion of the perforated pipe.

13. The method for forming a muffler according to claim 9, wherein, before the step of winding the fibrillated sound absorbing material on the outer peripheral portion of the perforated pipe, there is performed a step of providing a layer made of stainless steal wool on the outer peripheral portion of the perforated pipe.

14. The method for forming a muffler according to claim 8, wherein, before the step of winding the fibrillated sound absorbing material on the outer peripheral portion of the perforated pipe, there is performed a step of providing a layer made of stainless steal wool on the outer peripheral portion of the perforated pipe.

15. The method for forming a muffler according to claim 9, wherein, before the step of winding the fibrillated sound absorbing material on the outer peripheral portion of the perforated pipe, there is performed a step of providing a layer made of stainless steal wool on the outer peripheral portion of the perforated pipe.

16. The method for forming a muffler according to claim 10, wherein, before the step of winding the fibrillated sound absorbing material on the outer peripheral portion of the perforated pipe, there is performed a step of providing a layer made of stainless steal wool on the outer peripheral portion of the perforated pipe.

* * * * *